US008877288B2

(12) United States Patent
Shih et al.

(10) Patent No.: US 8,877,288 B2
(45) Date of Patent: Nov. 4, 2014

(54) HIGH ABRASION RESISTANCE COATING PROCESS

(75) Inventors: Michael Chung Wen Shih, Irvine, CA (US); Arthur Ming Jing Chen, Laguna Hills, CA (US)

(73) Assignee: AKKO Global, Irvine, CA (US)

( * ) Notice: Subject to any disclaimer, the term of this patent is extended or adjusted under 35 U.S.C. 154(b) by 150 days.

(21) Appl. No.: 12/720,433

(22) Filed: Mar. 9, 2010

(65) Prior Publication Data

US 2010/0227055 A1 Sep. 9, 2010

Related U.S. Application Data

(60) Provisional application No. 61/158,559, filed on Mar. 9, 2009.

(51) Int. Cl.

| | |
|---|---|
| ***B05D 3/02*** | (2006.01) |
| ***D06N 3/18*** | (2006.01) |
| ***D06M 23/10*** | (2006.01) |
| ***D06M 13/127*** | (2006.01) |
| ***D06N 3/14*** | (2006.01) |
| ***D06M 15/643*** | (2006.01) |
| ***D06M 15/564*** | (2006.01) |

(52) U.S. Cl.

CPC .. *D06N 3/14* (2013.01); *D06N 3/18* (2013.01); *D06M 23/10* (2013.01); *D06M 13/127* (2013.01); *D06M 15/643* (2013.01); *D06N 3/145* (2013.01); *D06M 15/564* (2013.01)

USPC ..... 427/209; 427/407.1; 427/412

(58) Field of Classification Search

None

See application file for complete search history.

(56) References Cited

U.S. PATENT DOCUMENTS

| | | | | | |
|---|---|---|---|---|---|
| 3,551,830 | A | * | 12/1970 | Patsis et al. | 442/76 |
| 3,598,633 | A | * | 8/1971 | Rudman | 442/71 |
| 3,900,688 | A | * | 8/1975 | Thoma et al. | 442/71 |
| 4,520,042 | A | * | 5/1985 | Smith | 427/209 |
| 4,613,527 | A | * | 9/1986 | Potter et al. | 427/412 |
| 4,935,485 | A | * | 6/1990 | Pedain et al. | 528/45 |
| 5,298,303 | A | * | 3/1994 | Kerr et al. | 428/35.7 |
| 2003/0039758 | A1 | * | 2/2003 | Wang et al. | 427/402 |

FOREIGN PATENT DOCUMENTS

| | | | |
|---|---|---|---|
| DE | 139130 | * | 12/1979 |
| HU | 42144 | * | 6/1987 |

OTHER PUBLICATIONS

Translation of HU 197369 B, Mar. 1989.*

* cited by examiner

*Primary Examiner* — Erma Cameron

(74) *Attorney, Agent, or Firm* — Charles C.H. Wu; Charles C.H. Wu & Assocs, APC

(57) ABSTRACT

A process for coating a front and back surface of an industrial textile to increase its abrasion resistance is disclosed. The coating process comprises the steps of coating the textile with a coating compound, heating coated textile at a temperature of 120 degree Celsius and drying the coated textile for 60 seconds. Two passes of coating is applied for the process wherein the viscosity for first pass of coating is 21000 centipoise and the viscosity for second pass of coating is 12000 centipoise. On completion of the coating process, the coated textile is treated with a water repellent agent. The coating compounds used for the process are comprised of formulations including two polyurethane compositions, which are mixed with a methyl ethyl ketone solvent, and the water repellent agent is silicone. The overall process requires a curing time of 2 minutes with a curing agent.

2 Claims, 3 Drawing Sheets

| 300D Polyester | Conventional Process | | Process of the present invention | |
|---|---|---|---|---|
| | Warp (lbf) | Weft (lbf) | Warp (lbf) | Weft (lbf) |
| Tensile (Ib)ASTM5034 | 200 | 200 | 200+ | 200+ |
| Tear (lb)ASTM2261 | 12 | 12 | 44.2 | 33.9 |
| Waterproof (mm) | 1500 | | 1500 | |
| Abrasion (1000g/H18) Cycles | 400 | | 1200 | |
| | | | | |
| 600D Polyester | Conventional Process | | Process of the present invention | |
| | Warp (lbf) | Weft (lbf) | Warp (lbf) | Weft (lbf) |
| Tensile (Ib)ASTM5034 | 200 | 200 | 200+ | 200+ |
| Tear (lb)ASTM2261 | 12 | 12 | 44.3 | 48.1 |
| Waterproof (mm) | 1500 | | 300 | |
| Abrasion (1000g/H18) Cycles | 400 | | 1500 | |
| | | | | |
| 900D Polyester | Conventional Process | | Process of the present invention | |
| | Warp (lbf) | Weft (lbf) | Warp (lbf) | Weft (lbf) |
| Tensile (Ib)ASTM5034 | 300 | 300 | 300+ | 300+ |
| Tear (lb)ASTM2261 | 18 | 18 | 104 | 53 |
| Waterproof (mm) | 1500 | | 400 | |
| Abrasion (1000g/H18) Cycles | 600 | | 3000 | |

Fig. 2A

| N200D | Conventional Process | | Process of the present invention | |
|---|---|---|---|---|
| | Warp (lbf) | Weft (lbf) | Warp (lbf) | Weft (lbf) |
| Tensile (lb)ASTM5034 | 300 | 300 | 300+ | 300+ |
| Tear (lb)ASTM2261 | 18 | 18 | 7 | 5 |
| Waterproof (mm) | 1500 | | TBA | |
| Abrasion (1000g/H18) Cycles | 500 | | 100 | |
| | | | | |
| N400D | Conventional Process | | Process of the present invention | |
| | Warp (lbf) | Weft (lbf) | Warp (lbf) | Weft (lbf) |
| Tensile (lb)ASTM5034 | 300 | 300 | 300+ | 300+ |
| Tear (lb)ASTM2261 | 18 | 18 | 49.6 | 54.4 |
| Waterproof (mm) | 1500 | | 1500 | |
| Abrasion (1000g/H18) Cycles | 500 | | 1500 | |
| | | | | |
| N840D | Conventional Process | | Process of the present invention | |
| | Warp (lbf) | Weft (lbf) | Warp (lbf) | Weft (lbf) |
| Tensile (lb)ASTM5034 | 350 | 350 | 350+ | 350+ |
| Tear (lb)ASTM2261 | 20 | 20 | 54 | 78 |
| Waterproof (mm) | 1500 | | TBA | |
| Abrasion (1000g/H18) Cycles | 800 | | 2400 | |
| | | | | |
| N1680D | Conventional Process | | Process of the present invention | |
| | Warp (lbf) | Weft (lbf) | Warp (lbf) | Weft (lbf) |
| Tensile (lb)ASTM5034 | 400 | 400 | 350+ | 350+ |
| Tear (lb)ASTM2261 | 35 | 35 | 209 | 181 |
| Waterproof (mm) | 1500 | | 1500 | |
| Abrasion (1000g/H18) Cycles | 1200 | | 3600 | |

Fig. 2B

HIGH ABRASION RESISTANCE COATING PROCESS

This application claims the benefit of U.S. Provisional Application No. 61/158,559 filed on Mar. 9, 2009.

BACKGROUND OF THE INVENTION

1. Technical Field of the Invention

The present invention relates in general to a coating process for an industrial textile. More specifically, the present invention relates to a polyurethane based coating process for coating a front and back surface of an industrial textile to increase abrasion resistance thereof.

2. Description of the Related Art

A wide range of textile products can be found in various industries whether it is automotive, travel, or sports. Examples of such products include but are not limited to luggage, bags, covers, hunting equipment, sporting equipment, and automotive upholstery. Within their normal use textile products are exposed to many elements. In the industries mentioned, these products generally must withstand frequent use, and increased exposure to harsh or abrasive environments, contact or treatment.

The consumer selection process for textile products sets relatively high standards with respect to durability or wear performance of the materials. Abrasion resistance is one of the main testing methods to determine the durability or wear performance. One of the most widely accepted testing standards is conducted using a machine and technique that produces a specified degree or amount of abrasion. Results of the test are measured in terms of the number of cycles the product withstands. Based on current standards, normal abrasion resistance for textile products falls within the range of 500 cycles.

Many factors can play a role in determining how a textile product withstands abrasion resistance. Such factors may include the mechanical properties of the fibers, construction of the fabrics, and the application of finishing materials to the fibers, yarn or fabric. In order to achieve maximum abrasion resistance, textile producers focus on the chemical composition or application of finishing materials.

Chemical composition of textiles is typically achieved by coating or laminating the fabric. Depending on how they are used, laminated fabrics do not provide the best option for textiles that will be exposed to highly abrasive environments. Within the uses identified above, coated fabrics are the mostly widely used and preferred. The coating agent and coating process has a significant impact on the level of abrasion resistance that a particular textile product can endure.

Hence, it can be seen, that there is a need for a process and chemical formulation for coating a front and back surface of an industrial textile to increase abrasion resistance thereof. Further, the needed process would provide an industrial textile that can withstand exposure to highly abrasive environments in varying industries in a manner that exceeds current standards. Moreover, the needed application process would provide high abrasion resistance for a fabric substrate over a regular polyurethane (PU) coating.

SUMMARY OF THE INVENTION

To minimize the limitations found in the prior art, and to minimize other limitations that will be apparent upon the reading of the specifications, the present invention discloses a process for coating a front and back surface of an industrial textile to increase its abrasion resistance. The coating process comprises the steps of coating the textile with a coating compound, heating the coated textile at a temperature of 120 degree Celsius, and then drying of the coated textile for 60 seconds. Two passes of coating is applied during the process, wherein the viscosity for first pass of coating is 21000 centipoise and the viscosity for second pass of coating is 12000 centipoise. On completion of the coating process, the coated textile is treated with a water repellent agent, preferably silicone. The overall process requires a curing time of 2 minutes with a curing agent.

The coating compound used in the coating process is comprised of two polyurethane compounds, and methyl ethyl ketone.

One objective of the invention is to provide an industrial textile that can withstand exposure to highly abrasive environments in varying industries in a manner that exceeds current standards.

Another objective of the invention is to provide a new coating application process that will provide high abrasion resistance for an industrial textile over a regular polyurethane (PU) coating.

A third objective of the invention is to provide a simple process that delivers approximately 300% more abrasion resistance without sacrificing tear, tensile strength and waterproof properties of an industrial textile.

These and other advantages and features of the present invention are described with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention, thus the drawings are generalized in form in the interest of clarity and conciseness.

FIGS. 2A and 2B are tables showing comparison between performance of the conventional process and the process of present invention.

DETAILED DESCRIPTION OF THE DRAWINGS

Figure 1:
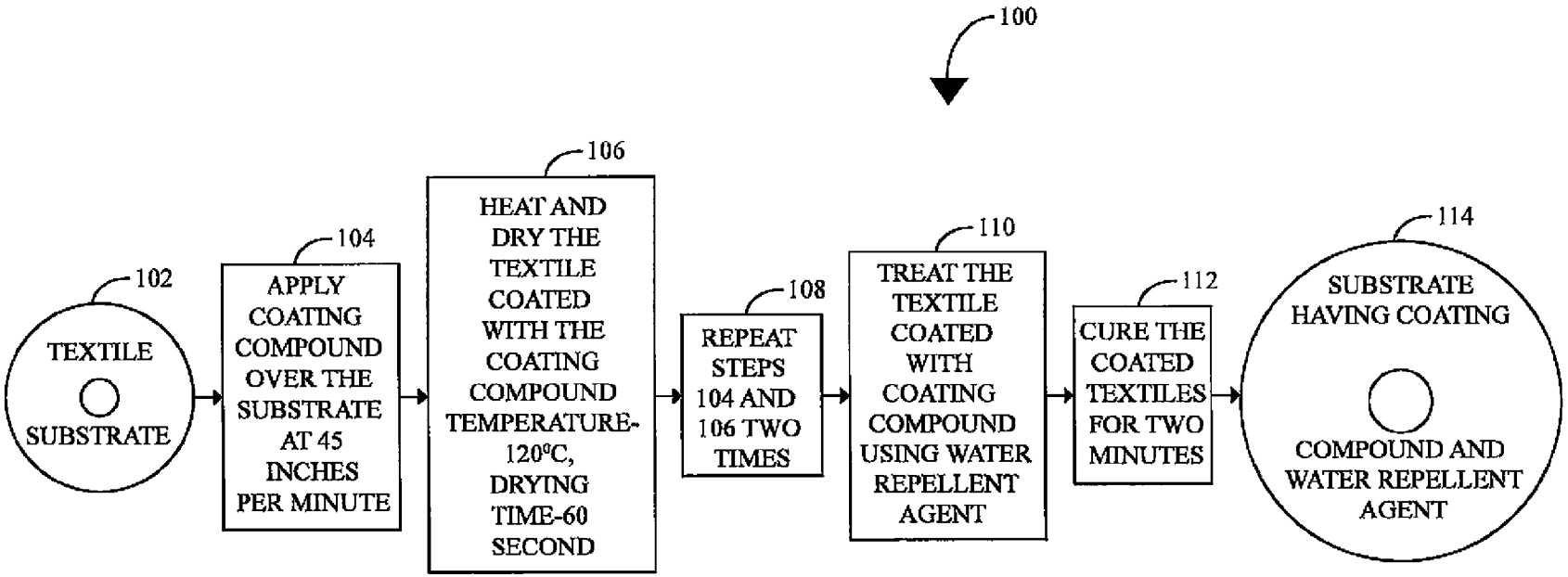
FIG. 1 is a process flow diagram of the present invention illustrating the steps of the process of the invention.

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

FIG. 1 is a process flow diagram 100, illustrating a process for coating a front and back surface of an industrial textile to increase its abrasion resistance. As indicated at process block 104, the textile substrate 102 is applied with a coating compound at a speed of 45 inches per minute. As depicted in process block 106, coated substrate is heated at a temperature of 120 degree Celsius, and then dried for 60 seconds. The steps depicted in process block 104 and process block 106 are repeated two times as in process block 108. The coated substrate is then treated with a water repellent agent, preferably silicone, as depicted in process block 110. The overall process requires a curing time of 2 minutes as depicted in process block 112. Finally, a substrate having coated compound and water repellent agent 114 is obtained.

The coating compound used in the process is a mixture comprised of two polyurethane compositions and methyl ethyl ketone. To achieve homogeneity, methyl ethyl ketone is added very slowly to polyurethane. Two passes of coating is applied during the process wherein the viscosity for first pass of coating is 21000 centipoise and the viscosity for second pass of coating is 12000 centipoise. The formulation for the first pass of coating substantially includes 120 grams of a polyurethane composition, 30 grams of a second polyurethane composition, and 5 grams of methyl ethyl ketone, and formulation for the second pass of coating substantially includes 120 grams of a polyurethane composition, 30 grams of a second polyurethane composition, and 15 grams of methyl ethyl ketone.

FIGS. 2A and 2B are tables showing comparison between performance of the conventional process and the process according to the present invention. The present invention includes a new fabric coating application process that provides high abrasion resistance for a fabric substrate over a regular polyurethane (PU) coating. Conventionally, fabrics with PU coating will provide only a limited strength of abrasion resistance. The abrasion resistance is measured in the number of rubbing cycles using the standard ASTM D3884-18 (500 g or 1000 g wheels). The process of the present invention delivers approximately 300% more abrasion resistance without sacrificing tear, tensile strength and waterproof properties. For example, from the table in FIG. 2A, it is clearly understood that the regular abrasion resistance for a 600D polyester is approximately 400 cycles under a 1000 g ASTM D3884 wheel. Under the same stress test, the same fabric applied with the process of the present invention will yield 1500 cycles. With the conventional process of PU coating, the water resistance of the 600D polyester is 1500 mm and with the process of the present invention, the fabric will yield the water resistance of 300 mm. The tear and tensile strength of the 600D polyester is also increased from 12 to 44.3 and 48.1 respectively, when the fabric is treated using the process of the present invention.

The foregoing description of the preferred embodiment of the present invention has been presented for the purpose of illustration and description. It is not intended to be exhaustive or to limit the invention to the precise form disclosed. Many modifications and variations are possible in light of the above teachings. It is intended that the scope of the present invention not be limited by this detailed description, but by the claims and the equivalents to the claims appended hereto.

What is claimed is:

1. A process for coating a front and back surface of an industrial textile to increase abrasion resistance thereof, the process comprising the steps of:

(a) providing a first pass of coating of the textile applied at a speed of 45 inches/minute, wherein viscosity is 21000 centipoise, comprising:

(i) a coating compound having a formulation including the following: 120 grams of a first polyurethane compound, 30 grams of a second polyurethane compound, and 5 grams of methyl ethyl ketone solvent, to provide high abrasion resistance for the textile at least three times the normal industry standard;

(b) providing a second pass of coating of the textile applied at a speed of 45 inches/minute, wherein viscosity is 12000 centipoise;

(c) heating and drying the textile after each coating at a heating temperature of 120 degrees Celsius with a drying time of 60 seconds;

(d) treating the coated textile with the water repellent agent, silicone; and (e) curing the coated textile for a period of 2 minutes.

2. The process according to claim 1, wherein a formulation for the second pass of coating of the textile comprises a coating compound having a formulation including the following: 120 grams of a first polyurethane compound, 30 grams of a second polyurethane compound, and 15 grams of methyl ethyl ketone.

* * * * *